United States Patent [19]

Lindmayer et al.

[11] Patent Number: 4,947,664

[45] Date of Patent: Aug. 14, 1990

[54] LOCK CYLINDER

[75] Inventors: Martin Lindmayer, Böblingen; Klaus Claar, Sindelfingen, both of Fed. Rep. of Germany

[73] Assignee: Daimler-Benz AG, Fed. Rep. of Germany

[21] Appl. No.: 393,229

[22] Filed: Aug. 14, 1989

[30] Foreign Application Priority Data

Aug. 12, 1988 [DE] Fed. Rep. of Germany ..... 3827418

[51] Int. Cl.[5] ..... E05B 63/00

[52] U.S. Cl. ..... 70/422; 70/379 R

[58] Field of Search ..... 70/422, 379 R, 380, 70/222, 223, 224

[56] References Cited

U.S. PATENT DOCUMENTS

| | | | |
|---|---|---|---|
| 3,587,261 | 2/1971 | Berry | 70/422 |
| 3,621,685 | 11/1971 | Sargent | 70/422 |
| 4,394,821 | 7/1983 | Best | 70/422 |
| 4,550,581 | 11/1985 | Best | 70/422 |
| 4,559,795 | 12/1985 | Zagoroff | 70/422 |
| 4,773,240 | 9/1988 | Foshee | 70/422 |

FOREIGN PATENT DOCUMENTS

| | | |
|---|---|---|
| 2822098 | 11/1979 | Fed. Rep. of Germany . |
| 0139550 | 2/1987 | France . |

*Primary Examiner*—Robert L. Wolfe

*Attorney, Agent, or Firm*—Evenson, Wands, Edwards, Lenahan & McKeown

[57] ABSTRACT

A lock cylinder having a cylinder housing in which a cylinder core is rotatably disposed and which can be locked with the cylinder housing via spring-loaded tumblers upon the withdrawal of a key from a key duct of the cylinder core. A bearing sleeve encloses the cylinder housing and the cylinder housing is rotationally fixed by means of an overload coupling in this bearing sleeve. A rotary connecting element, arranged behind the lock cylinder, leads to a locking mechanism which and can be connected with the cylinder core by a separating coupling. The lock cylinder, while maintaining its overload protection, becomes suitable for the rotational control of a locking mechanism which is arranged separately of the lock cylinder. The separating coupling, irrespective of the locking condition of the lock, remains permanently engaged during rotating movements of the cylinder core with respect to the rotationally fixed cylinder housing and can be automatically disengaged by a control device only in the case of an overload rotation of the cylinder housing with respect to the bearing sleeve, and before an opening angle of rotation of the cylinder core is reached.

16 Claims, 2 Drawing Sheets

LOCK CYLINDER

BACKGROUND AND SUMMARY OF THE INVENTION

The invention relates to a lock cylinder having a cylinder housing in which a cylinder core is rotatably disposed and which can be locked with the cylinder housing through spring-loaded tumblers by the withdrawal of a key from a key duct of the cylinder core. The lock has a bearing sleeve enclosing the cylinder housing in which the the cylinder housing is rotationally fixed by an overload coupling in the bearing sleeve. A rotary connecting element is arranged behind the lock cylinder and is connected to a locking mechanism by a separating coupling from the cylinder core. The separating coupling is subjected to a forced mechanical control and is operated in response to a relative rotation of the cylinder core with respect to the bearing sleeve.

A lock cylinder of this general type is known from European Pat. No. EP 0 139 550. There, the known lock cylinder and the whole locking mechanism of the lock are combined into a compact structural unit. As long as the lock is unlocked, the cylinder core is form-lockingly connected with a cam disk by means of a separating coupling which is non-rotatably connected with this cylinder core. In contrast, when the lock is locked, the separating coupling is disengaged, with the result that the rotary connection no longer exists between the cylinder core and the cam disk. Since the assigned locking mechanism can be driven only by means of a rotary advancing of the cam disk, it can no longer be actuated by means of the lock cylinder when the separating coupling is disengaged.

Because of this separation of the locking mechanism and the lock cylinder when the lock is locked, the lock cylinder is better protected with respect to violent destruction during break-in attempts.

Specifically, if a "false" key or a tool which is similar to a key shank, such as a screw driver point, is inserted into the keyhole, and an overload torque is exercised on the cylinder core, the cylinder housing, which is locked with the cylinder core by means of the tumblers, rotates in the bearing sleeve as soon as the form-locking, (which exists between the bearing sleeve and the cylinder housing through a ball catch device) is overcome by pressure. In this case, the torque limit of the overload coupling may be dimensioned such that damage to the tumblers as a result of shearing-off stress is avoided. After the cylinder housing is rotated by 360°, the spring-loaded ball of the detent device will again lock in its spherical ball seat at the circumference of the cylinder housing, so that the cylinder housing is again fixed in its initial position.

However, in this known lock cylinder, a permanent rotary connection between the cylinder core and the cam disk acting as the rotary connecting element is not possible without difficulties, because such results in losing the possibility of changing the locking condition of the lock.

Lock cylinders of motor vehicles are known to be arranged separately from the lock as evidenced by German Pat. No. DE-OS 28 22 098. The locked condition of locks of this type is not achieved by a locking at the lock cylinder, but rather in a lever gear of a main plate, which requires a permanent rotary connection between the cylinder core and the lever gear. For this purpose, a rotary connecting element is disposed at the rear end of the lock cylinder, which is non-rotatably connected with the cylinder core, and which, by a revolving rod, is rotationally coupled with the lever gear of the lock. However, this type of a lock cylinder does not provide any protection from damage to the lock cylinder as a result of the aforementioned tampering for the purpose of forcing the lock open.

The invention is based on the object of further developing a lock cylinder of the above-mentioned types so that, while retaining its overload protection, it is also suitable for the rotational control of a locking mechanism arranged separately from the lock cylinder.

This object is achieved by having the separating coupling permanently engaged during rotating movements of the cylinder core with respect to the rotationally fixed cylinder housing, irrespective of the locking condition of the lock, and by having the coupling only be forced into a disengaged position in the course of an overload rotation of the cylinder housing with respect to the bearing sleeve when the disengaging operation is concluded before a certain opening rotational angle of the cylinder core (which is also rotated along), is reached. Thus, the rotary connection between the cylinder core and the rotary connecting element is maintained continuously if the lock cylinder is operated normally with the proper key.

In this case, the control device, particularly in view of the resulting high operational reliability, preferably consists of purely mechanical structural members.

A particularly space-saving construction can be achieved if the separating coupling can be disengaged by an axial movement that extends coaxially with respect to the lock cylinder. Here, a rotation of the cylinder housing in the bearing sleeve can be converted directly into a disengaging movement.

It is advantageous if the rotating movement of the cylinder housing with respect to the bearing sleeve can be converted to the coaxial disengaging advance of the separating coupling. Such an operation is obtained when a ring face of the cylinder housing interacts form-lockingly with a disengaging sleeve, which is non-rotatably held in the bearing sleeve and is subjected to an axial spring load.

The form locking mechanism comprises two detent cams which engage in assigned detent indentations. The separating coupling has a forked claw which is a component of a sliding claw and is guided axially on a driver shaft of the rotary connecting element. The forked claw projects out of the cylinder core side, while being non-rotatably supported at the cylinder core in the engaged condition. The sliding claw has two diametrically arranged forked claws which form-lockingly reach around two drivers fixed at the cylinder core.

The disengaging sleeve is slidingly disposed in the bearing sleeve, by axial sliding devices. An outer circumference of the sliding claw is axially moveable and supported in a rotatably disposed manner and is surrounded by an inwardly bent guiding neck of the disengaging sleeve.

The guiding neck is molded to the disengaging sleeve and is recessed with respect to the outer circumference. One end of a compression spring is supported on the face of the disengaging sleeve between the guiding neck and the inner circumference of the bearing sleeve. A rear end of the bearing sleeve can be closed off by a bearing cover and the compression spring is prestressable by a bearing cover flange of the cover which telescopically engages in the bearing sleeve.

Other objects, advantages and novel features of the present invention will become apparent from the following detailed description of the invention when considered in conjunction with the accompanying drawings.

DETAILED DESCRIPTION OF THE DRAWINGS

Figure 1:
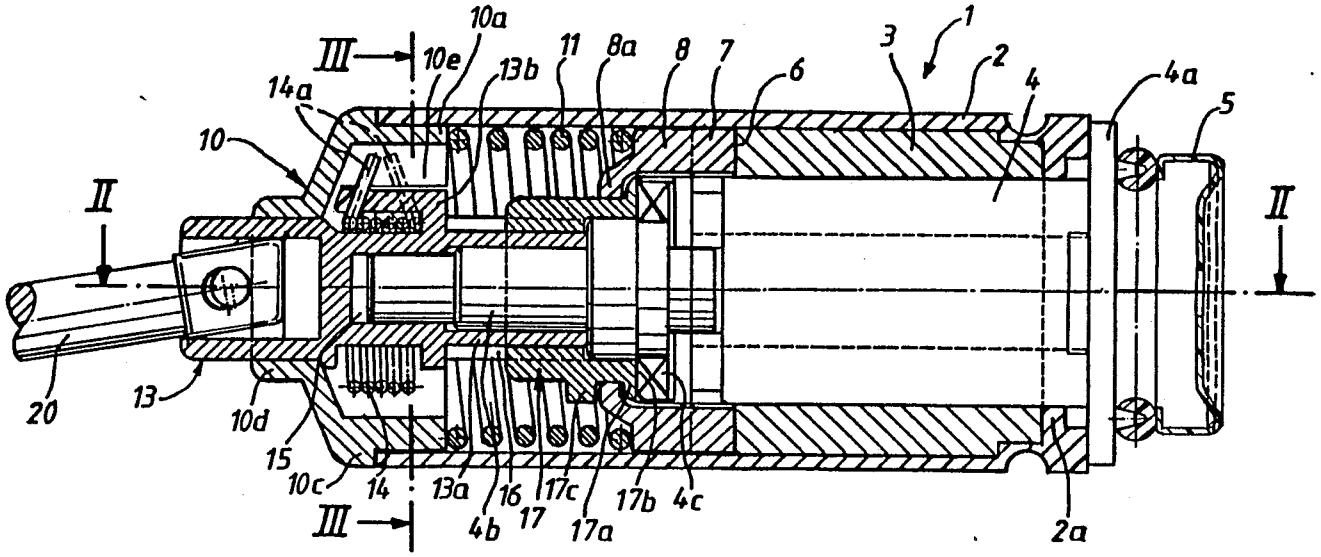
FIG. 1 is a longitudinal sectional view of a lock cylinder.
Figure 2:
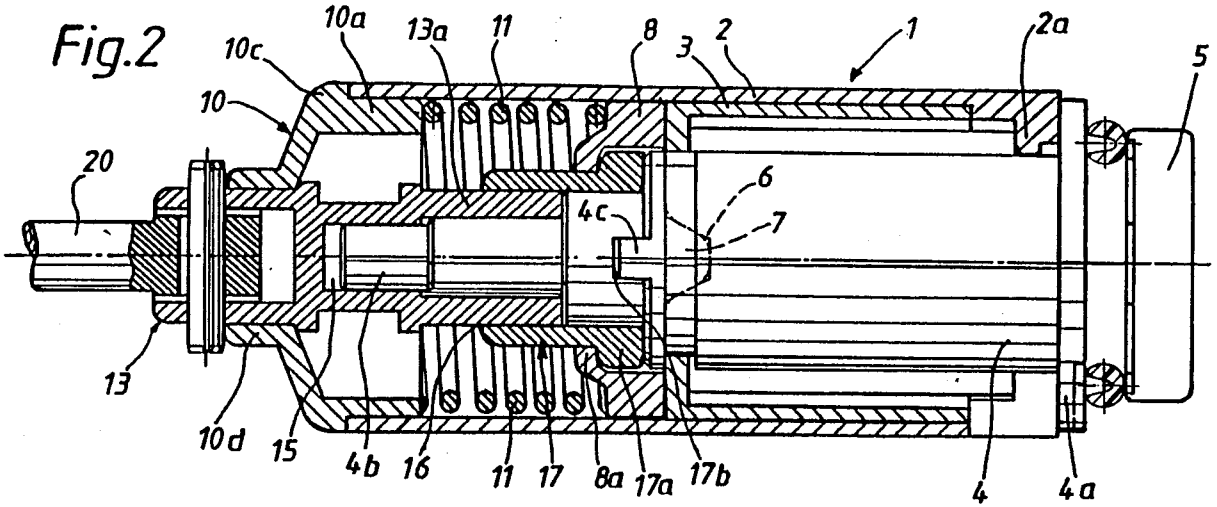
FIG. 2 is a sectional view according to Line II—II in FIG. 1.

A lock cylinder unit 1 is provided for mounting into a motor vehicle door (not shown) by fastening of a bearing sleeve 2 which completely surrounds the lock cylinder unit 1. The bearing sleeve 2 consists of a thin-walled hollow cylinder which ends in an inwardly directed ring-shaped stop collar 2*a* on the operating side of the unit. A cylinder housing 3 rests against the inner circumference of the bearing sleeve 2 This lock cylinder housing 3 is slid into the bearing sleeve 2 from the rear. Play exists between the outer circumference of the cylinder housing 3 and the inner circumference of the bearing sleeve 2 so that the cylinder housing 3 is rotatable in the bearing sleeve 2 in a precise but easily movable manner. A cylinder core 4 is pushed into the cylinder housing 3 from the operating side of the lock cylinder unit 1. The accessible face of this cylinder core 4 is thickened to a larger diameter by means of a surrounding ring collar 4*a*. The sliding of the cylinder core 4 into the cylinder housing 3 is limited through a countersurface of the stop collar 2*a* when its end position is reached. The cylinder core 4, together with a dust cap 5 including a sealing arrangement, is supported by means of a holding part (not shown) and which can be fixedly screwed to the door.

Figure 3:
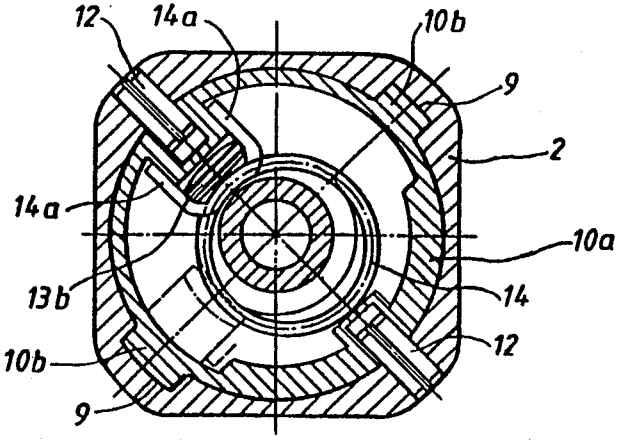
FIG. 3 is a sectional view according to Line III—III in FIG. 1.

The rear ring face of the cylinder housing 3 is provided with two detent indentations 6 which are arranged at 180° diametrically with respect to one another and which, when viewed from the circumference, have the shape of a tooth. The lateral flanks of the detent indentations 6 are each sloped diagonally with respect to one another resulting in a trapezoidal clear opening. Detent cams 7 engage form-lockingly in these detent indentations 6 and project laterally (axially) from a ring face of a disengaging sleeve 8 which is disposed opposite the ring face of the cylinder housing 3. Since the detent cams 7 are molded to the disengaging sleeve 8, a non-rotatable connection exists between the sleeve 8 and cylinder housing 3 when the cams 7 are engaged into the detents 6. The disengaging sleeve 8 is a body having the basic shape of a hollow cylinder, the outside diameter of which is adapted to the inside diameter of the bearing sleeve 2. As a result, the disengaging sleeve 8 is coaxially guided longitudinally slidably in the bearing sleeve 2. However, in contrast to the cylinder housing 3, it is not freely rotatably disposed in the bearing sleeve 2, but is supported therein in a torsionally stable manner. For this purpose, several parallel-extending guide channels 9 (FIG. 3) are recessed out of the circumference of the bearing sleeve 2. These guide channels 9 act in the manner of a drawer guiding arrangement, blocking rotation while permiting a sliding movement. The bearing sleeve 2 is not penetrated by the continuous slots of the guide channels 9, which would lead to a considerable weakening of its rigidity with respect to torsion. To that end, the cylinder wall of the bearing sleeve 2, in the areas in which its cross-section is weakened, is thickened to such an extent that its original stability is restored. This is obtained by having outer-circumferential contour of the sleeve 2 have a cross-section of a basic square shape with rounded-off corners. The guide channels 9 are located in these corners.

The guide channels 9 extend continuously to the rear end of the bearing sleeve 2, whereby they can be utilized for the blocking of the rotation of a bearing cover 10 connected with the bearing sleeve 2. The bearing cover 10 has an annular bearing cover flange 10*a* which, in the manner of a telescope, can be slid into the bearing sleeve 2. Two sliding elements 10*b* are diametrically assigned in the two guide channels 9 to form-lockingly engage into these guide channels 9. In addition, the bearing cover 10 is equipped with a surrounding edge 10*c* which limits the inserting advance of the bearing cover flange 10*a* by stopping against the rear face of the bearing sleeve 2. A compression spring 11 is supported between the ring face of the bearing cover flange 10*a* and an opposite ring face of the disengaging sleeve 8. The coil diameter of this spring 11 is adapted to the inside diameter of the bearing sleeve 2. In its installed condition, this compression spring 11 is under an axial prestress which is indicative of the torque limit of the overload. The disengaging sleeve 8 is pressed against the face of the cylinder housing 3 with the prestressed force of the compression spring 11. The bearing cover 10 is held in its installed position by means of two tensioning pins 12, which penetrate fitted bores in the bearing sleeve 2 and in the bearing cover flange 10*a*. As a result of this type of fastening, the compression spring 11 is prestressed as the bearing cover flange 10*a* is pushed into the bearing sleeve 2 when the lock cylinder unit 1 is assembled.

A rotary connecting element 13 is rotatably disposed in the center in the bearing cover 10 by a bearing neck 10*d* which is molded to the bearing cover 10. A revolving rod 20 is flexibly connected to the end of a rotary connecting element which projects out of the bearing cover 10. This revolving rod 20 (in a known manner not shown) provides rotary connection between the rotary connecting element 13 and the lever gear of a lock. This rotary connection permits the changing of the locking condition of the lock as a function of rotating movements the cylinder core 4. For this purpose, the cylinder core 4 must be rotatable together with the rotary connecting element 13. The rotary connecting element 13 has a hollow-cylindrical driver shaft 13*a* which extends coaxially with respect to the cylinder core 4 toward its rear face and ends at a longitudinal distance from the cylinder core 4. A linear section of the driver shaft 13*a* located adjacent the bearing cover which is used as a seat for a leg spring 14 arrangement, by means of which the rotary connecting element 13 can be turned into a zero position For this purpose, the coil of a leg spring 14 encloses the longitudinal area of the driver shaft 13*a* and supports itself, by means of two end-side radially bent spring legs 14*a* on opposite sides of a holding leg 13*b* fixed to the shaft. The spring legs 14*a* have a length to project radially beyond the extent of the holding leg 13*b* and reach around a support mandrel 10e located opposite the holding leg 13*b* and projecting away from the inner circumference of the bearing cover flange 10*a*. In addition, the inside circumferential contour of the bearing cover flange 10*a* is constructed in such a manner that the rotating movement of the rotary connecting element 13, starting from the zero position, is limited in both direction by stop surfaces after rotating through an angle of 90°.

The driver shaft 13*a* also has an inside bore 15 which has several inside steps and in which a shaft 4*b* is rotatably secured. The shaft 4*b* has several countersteps and is fixedly connected with the cylinder core 4. On its outer circumference, it is provided with axial toothing 16 onto which a sliding claw 17 is provided. The claw 17 has axial countertoothing. The sliding claw 17, which is constructed at a cylindrical ring body, ends in front of a ring face of the cylinder core 4 in a torus 17*a* of a larger diameter, the face of which rests flatly against the ring face of the cylinder core 4.

In order to establish a rotary connection between the sliding claw 17 and the cylinder core 4, two diametrically opposite rectangular windows are extended axially out of the wall of the sliding claw 17 to define two forked claws 17*b*. These forked claws 17*b* form-lockingly reach around two assigned drivers 4*c*, which are molded to the ring face of the cylinder core 4. As long as the sliding claw 17 maintains its shown position, each rotation of the cylinder core 4 is transmitted synchronously to the rotary connecting element 13.

In order to allow the driver connection to become a separating coupling, the sliding claw 17 is made to advance with the disengaging sleeve 8. For this purpose, a guiding neck 8*a* is molded to the front face of the disengaging sleeve 8. The guiding neck 8*a* has a smaller diameter at its inner portion than does the disengaging sleeve 8 itself. The guiding neck 8*a* remains free of the rebounding force of the compression spring 11 so that it may be dimensioned to be correspondingly slim.

In a circular manner, the guiding neck 8*a* tapers off at a bend which, when viewed in cross-sectional direction, is approximately rectangular and ends in a bore, which precisely encloses the circumference of the sliding claw 17. For the axial support of the guiding neck 8*a*, at the sliding claw 17, the edge zone of the guiding neck 8*a* close to the bore, is clamped with rotational play between the torus 17*a* and a locking lug 17*c* molded to the sliding claw 17. The engaged position of the separating coupling is therefore maintained, in that the disengaging sleeve 8 under the loading by the spring 11, is pressed against the ring face of the cylinder housing 3 and as a result thereof, the sliding claw 17 is also axially held against the cylinder housing 3.

If one attempts to force a turning of the cylinder core 4, which is locked to the cylinder housing 3 by way of tumblers when the key is withdrawn, the following operation will be initiated:

Up to a torque limit of, for example, 5 Nm, the cylinder housing 3 remains fixed in the bearing sleeve 2. The introduced torque is transmitted without effect by the side walls of the detent indentations 6 to the opposite flanks of the detent cams 7. In the process, two forces are generated with one component in a circumferential direction and a second component in an axial direction, these forces being the result of the diagonal course of the wide wall and of the flanks. The component in circumferential direction is inflexibly supported by the rotational blocking of the disengaging sleeve 8 in the guide channels 9. In contrast, the axial component, after an overload torque is reached, leads to a lifting movement of the disengaging sleeve 8 in the bore of the bearing sleeve 2. The lifting movement path being indicated by the depth of the detent indentations 6. As a result of the axial support of the guiding neck 8*a* at the locking lug 17*c*, the sliding claw 17 participates in this lifting movement of the disengaging sleeve 8 against its spring load, in which case the forked claws 17*b* are also shifted with respect to the drivers 4*c*.

Since the engaging depth of the drivers 4*c* in the forked claws 17*b* is less than the depth of the detent indentations 6 or the engaging depth of the detent cams 7, no rotary connection exists between the cylinder core 4 and the rotary connecting element 10 when the engaging sleeve 8 in the lifted-out position. The detent cams 7 now support the force of the compression spring 11 on the ring face of the cylinder core 4 between the two detent indentations 6. After an angle of rotation of 180°, the detent cams 7 automatically engage again in the detent indentations 6 and the disengaging sleeve 8, is pressed back into its form-locking position under its spring load. Since the sliding claw 17 also participates in this engaging advance, the driver form-locking between the forked claws 17*b* and the drivers 4*c* is also automatically reestablished, whereby the lock cylinder unit 1, without having suffered any damage, can again be normally operated by means of a key. Although, an engaging key turn angle of rotation of the cylinder housing 3 with respect to the bearing sleeve 2 of 180° may be sufficient, after which the engaged position should be achieved again, it is also conceivable to enlarge the engaging angle of rotation to 360°. This is possible by providing different circumferential widths of the two drivers 4*c* together with the pertaining forked claw 17*b*.

The present locked position of the lock (when the cylinder housing 3 is rotated with respect to the bearing sleeve 2) is maintained only if the disengaging angle of rotation of the cylinder housing 3 is smaller than the opening angle of rotation of the cylinder core 4, because the cylinder core 4 is forced to rotate along with the cylinder housing 3.

If an influencing of the lock by rotating manipulations of the cylinder core 3 is to be made completely impossible, a free-moving rotary play is required in the rotary transmission between the rotation-transmitting element 13 and the lock. This free-moving rotary play is at least as large as the disengaging rotary angle of the cylinder housing 4. In the case of locking devices which are locked on the lever gear side, a sufficient free movement is available as a result of the absolutely necessary rotary return play of the key.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A lock cylinder having a cylinder housing in which a cylinder core is rotatably disposed and which can be locked to the cylinder housing by spring-loaded tumblers upon withdrawal of a key from a key duct at an open end of the cylinder core;

a bearing sleeve enclosing the cylinder housing;

the cylinder housing being rotationally fixed to the bearing sleeve;

an overload coupling means;

a rotary connecting element arranged behind the cylinder core, at an end opposite the open end, and connected by a separating coupling means to the cylinder core;

the separating coupling means being responsive to a forced mechanical disengaging movement, caused by a relative rotation of the cylinder core with respect to the bearing sleeve, wherein the separating coupling means is permanently engaged during rotating movements of the cylinder core with respect to the rotationally fixed cylinder housing irrespective of whether the cylinder core is a locked or unlocked condition, and the separating coupling means is forced into a disengaged arrangement from an overload rotation of the cylinder housing with respect to the bearing sleeve, when the disengaging operation is concluded before a certain opening rotational angle of the cylinder core is reached.

2. A lock cylinder according to claim 1, wherein rotating movement of the cylinder housing with respect to the bearing sleeve causes a coaxial disengaging advance of the separating coupling means.

3. A lock cylinder according to claim 2, wherein there are form-locking means for locking a ring face of the cylinder housing with a disengaging sleeve, which is non-rotatably held in the bearing sleeve and which is subjected to an axial spring load.

4. A lock cylinder according to claim 3, wherein the form-locking means comprises two detent cams which engage in assigned detent indentations.

5. A lock cylinder according to claim 5, wherein the separating coupling means has a forked claw which is a component of a sliding claw.

6. A lock cylinder according to claim 5, wherein the sliding claw is guided axially on a driver shaft of the rotary connecting element;

wherein the forked claw projects forwardly in the direction of the cylinder core and wherein the sliding claw is non-rotatably supported at the cylinder core in the engaged condition.

7. A lock cylinder according to claim 6, wherein the sliding claw has two diametrically arranged forked claws which form-lockingly reach around two drivers of the cylinder core.

8. A lock cylinder according to claim 3, wherein in the disengaging sleeve is slidingly disposed in axial sliding devices on the bearing sleeve.

9. A lock cylinder according to claim 6, wherein an outer circumference of the sliding claw is axially supported in a rotatably disposed manner for axial movement and is surrounded by an inwardly bent guiding neck of the disengaging sleeve.

10. A lock cylinder according to claim 7, wherein an outer circumference of the sliding claw is axially supported in a rotatably disposed manner for axial movement and is surrounded by an inwardly bent guiding neck of the disengaging sleeve.

11. A lock cylinder according to claim 9, wherein the guiding neck, is molded to the disengaging sleeve and radially offset from an outer circumference of said disengaging sleeve.

12. A lock cylinder according to claim 10, wherein the guiding neck, is molded to the disengaging sleeve and radially offset from an outer circumference of said disengaging sleeve.

13. A lock cylinder according to claim 11, wherein one end of a compression spring is supported on a face of the disengaging sleeve between the guiding neck and an inner circumference of the bearing sleeve.

14. A lock cylinder according to claim 12, wherein one end of a compression spring is supported on a face of the disengaging sleeve between the guiding neck and an inner circumference of the bearing sleeve.

15. A lock cylinder according to claim 13, wherein a rear end of the bearing sleeve is closed off by a bearing cover and wherein the compression spring is prestressable by a bearing cover flange of the bearing cover, which telescopingly engages in the bearing sleeve.

16. A lock cylinder according to claim 14, wherein a rear end of the bearing sleeve is closed off by a bearing cover and wherein the compression spring is prestressable by a bearing cover flange of the bearing cover, which telescopingly engages in the bearing sleeve.

* * * * *